United States Patent [19]

Desty

[11] 4,073,613

[45] Feb. 14, 1978

[54] FLARESTACK COANDA BURNERS WITH SELF-ADJUSTING SLOT AT PRESSURE OUTLET

[75] Inventor: Denis Henry Desty, Weybridge, England

[73] Assignee: The British Petroleum Company Limited, London, England

[21] Appl. No.: 589,085

[22] Filed: June 23, 1975

[30] Foreign Application Priority Data

June 25, 1974 United Kingdom ..... 28094/74

[51] Int. Cl.[2] ..... F23D 13/20; B05B 1/26

[52] U.S. Cl. ..... 431/202; 431/354; 239/506; 239/DIG. 7; 417/189

[58] Field of Search ..... 431/354, 202, 353; 239/416.5, DIG. 7, 506; 417/191, 189, 184; 60/39.49

[56] References Cited

U.S. PATENT DOCUMENTS

| | | | |
|---|---|---|---|
| 3,086,548 | 4/1963 | Galiger et al. | 417/189 |
| 3,695,820 | 10/1972 | Hawkes et al. | 431/354 |
| 3,833,337 | 9/1974 | Desty et al. | 431/202 |
| 3,853,457 | 12/1974 | Desty et al. | 431/328 |

*Primary Examiner*—Carlton R. Croyle
*Assistant Examiner*—Thomas I. Ross
*Attorney, Agent, or Firm*—Morgan, Finnegan, Pine, Foley & Lee

[57] ABSTRACT

A Coanda unit has a Coanda surface and a gas supply line terminating in a slot adjacent to the Coanda surface. One side of the slot is contiguous with the Coanda surface and the other side is formed of a tongue of resilient material which flexes within defined limits in response to the pressure of the gas supply so as to vary the slot width.

16 Claims, 5 Drawing Figures

FLARESTACK COANDA BURNERS WITH SELF-ADJUSTING SLOT AT PRESSURE OUTLET

This invention relates to a flare for disposing of combustible gases from e.g. marine platforms, and in particular it relates to the disposal of petroleum gas during emergency situations.

The flaring off of gases from production units situated on marine platforms presents special problems. In view of the limited space available on the platform the flame arising from the flare must either have low radiation of heat or be shielded so as to protect personnel from radiation, flame lick and high temperature flue gas impingement. A further requirement is that the noise arising from the flaring procedure is not excessive.

Conventional flares are not very suitable on limited marine platform areas the resultant long flames being difficult to shield with the consequent radiation and flame lick hazards.

It is also desirable that the flare is capable of coping with a fairly large variation of gas throughput while still maintaining a stable flame i.e. the flare should have a large turndown ratio. One way of achieving a large turndown ratio is the use of a flare of the Coanda type (e.g. our U.S. Pat. No. 3,833,337) which has a self-adjusting or variable slot outlet. By the term self-adjusting is meant a slot or supply line closure which adjusts itself automatically to the flow rate of high pressure gas so that the pressure of the gas remains approximately constant on emergence from the slot.

A new approach to the self-adjusting slot objective has now been conceived.

Coanda type flares can be either internal (e.g. as in our UK Pat. No. 1,278,577) or external (e.g. as in our U.S. Pat. No. 3,709,654). The Coanda effect can also be employed in the construction of air movers in which case a housing may be provided around the Coanda body. In all these types of unit, the provision of a self-adjusting variable slot outlet offers potential advantages and greater flexibility of operation.

According to the present invention, there is provided a Coanda unit comprising a supply line for a pressurised gas and a Coanda body positioned across the outlet of the supply line so as to define a slot for discharging the gas along the surface of the Coanda body, one edge of the slot being contiguous with the Coanda surface, the opposite edge of the slot being formed from a resilient flap capable of bending within defined limits in response to the pressure of the gas supply to vary the effective slot width.

In accordance with normal practice, there is preferably means for reducing the gas velocity after its passage over the Coanda surface.

The means for reducing the gas velocity is preferably a tube or region of increasing cross-sectional area and is most preferably a diffuser cone or trumpet projecting above the top plate of the fuel chamber from each tube. The cone dimensions employed are dependent on the gases flared. Preferably the diffuser cone (a truncated cone) has an included angle of 3°–10°, most preferably 4°–6° and the diffuser cone mouth diameter is from 1½ to 2 times its throat diameter.

In order to further stabilize the flame, a bluff body or baffle is preferably located above the flare unit.

Depending upon the quantity of gas to be flared, a number of Coanda flare units may be built into an array. Preferably the centre of each Coanda flare unit of the array is separated by a distance of 2 to 3 trumpet exit diameters. This arrangement assists optimum secondary air entrainment to be achieved.

During use of the element in a flare it is preferable to incorporate pilot lights. Preferably, particularly during use on a marine platform, radiation and/or windshields are associated with the flare.

Preferably the resilient flap is pre-loaded against the Coanda surface i.e. the supply line is closed at zero pressure. The flap is held at one side of the slot but free at the Coanda surface side so that the effective width of the slot varies in response to the gas pressure.

Preferably the resilient flap takes the form of an annular ring, most preferably of constant thickness. For an internal Coanda surface, the outer edge of the ring is held with the inner edge being free to move in response to gas pressure. For an external Coanda surface, the reverse applies.

In some applications, it is preferable if the resilient flap takes the form of two or more annular rings together, particularly where undesirable oscillation is set up when a single ring is used.

Different fuel gases require different gap openings e.g. methane requires less air than propane for complete combustion. Thus the resilient flap may be pre-loaded to different opening pressures depending upon the gas being flared.

The flap is constructed from a resilient deformable material having a high modulus of rigidity to ensure that marked changes in deformation characteristics do not occur during the many operational cycles. Examples of suitable materials include martinsitic steel, ferritic stainless steel, ferrallium (a heat treated stainless steel) beryllium-copper, aluminium alloys, carbon fibre composites. For marine operations, the material of construction should be sea water resistant.

Desirably the movement of the flap is limited by a stop. The gap between the resilient flap and Coanda surface typically varies between 0 to 50 thousandths of an inch. The variable gap width enables flushing and cleaning to be carried out, an advantage over the fixed gap flares which sometimes have blockage problems due to cracking of liquid fuel carry over blocking the gap.

In a further embodiment of the invention the resilient flap comprises a resilient truncated conical ring of constant thickness (e.g. Belleville washer) pivotally mounted at the mouth of the gas supply line. A gas sealing element is provided at the pivot so as to prevent undesirable fuel gas escape.

The invention will now be described by way of example only with reference to FIGS. 1 to 5 of the drawings accompanying the Specification.

FIG. 1 shows a flare assembly comprising 19 internal Coanda units attached to a manifold which may be mounted at the top of a stack on a deep water marine platform.

Figure 1:
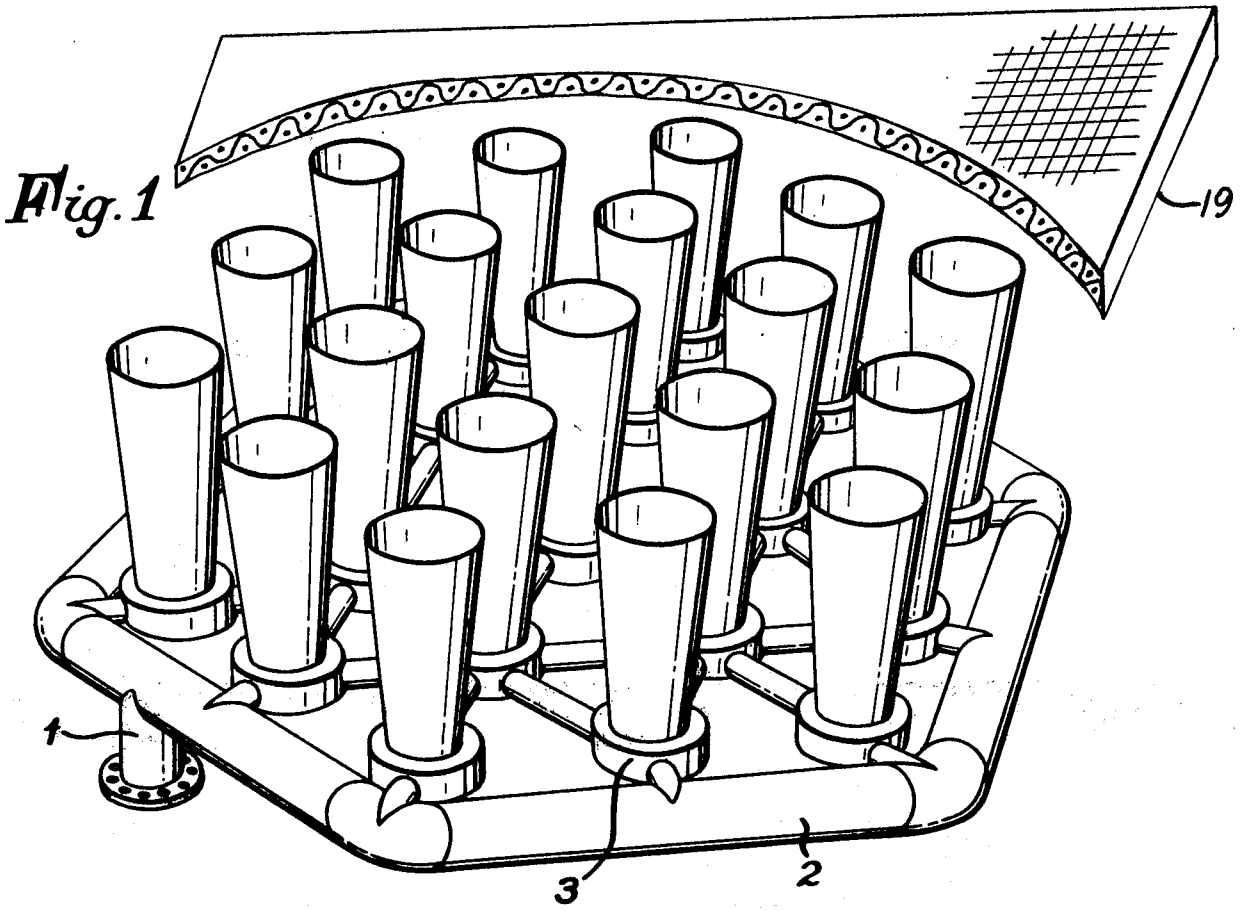
FIG. 1 shows a perspective view of a small field flare containing 19 units according to the invention.

The high pressure fuel gas is fed into the flare assembly by means of a fuel inlet pipe 1 from gas-oil separators (not shown) and is distributed by the manifold 2 to the individual Coanda units 3. The flare assembly is usually mounted on a tower at a height of about 100' above the platform. Conventional ignition devices are used to light the flare. Conventional baffle 19, shown schematic, may be used to stabilize the flame from the flare assembly, if necessary.

The flare may also be formed in modules. For example, a 24 Coanda unit flare may be formed from 6 modules each having 4 units, each module being linked by a fuel supply manifold.

Figure 2:
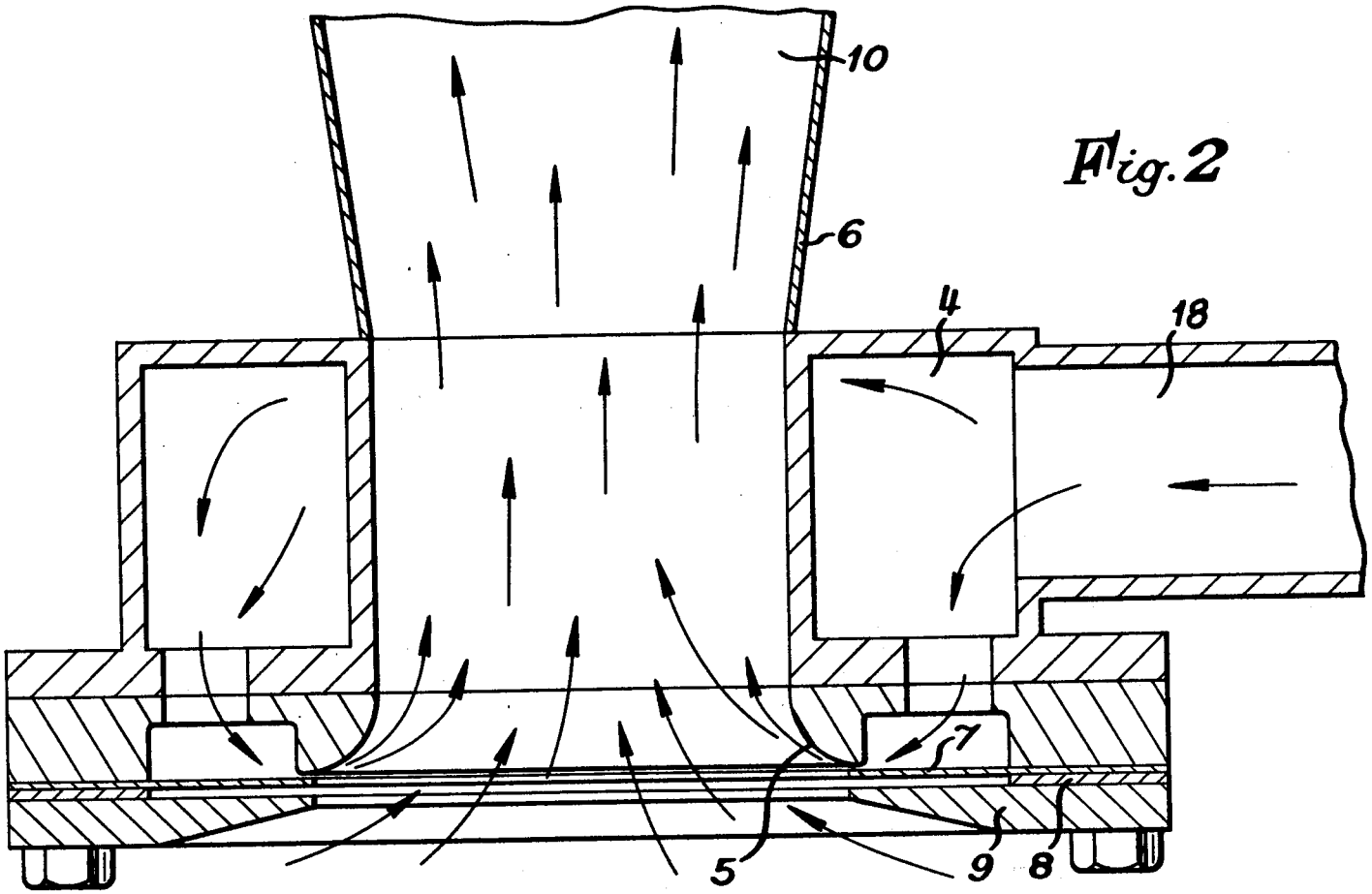
FIG. 2 is a vertical section through a single flare unit using a deformable annular ring showing the construction and gas and air flows.

FIG. 2 shows that each Coanda flare unit is attached to a supply pipe 18 which is connected to the manifold 2 supplying the high pressure fuel gas. The supply pipe 18 passes to an annular fuel transfer chamber 4 which connects with the internal Coanda surface 5 at the throat of a diffuser cone 6 when a deformable element 7 is opened by the fuel gas pressure.

The deformable element 7 takes the form of an annular ring which is clamped at its outer edge to the main body of the flare unit. A spacer 8 is used to adjust the position of the annular ring depending on the type of fuel gas and pressures used and a limit plate 9 restricts the movement of the ring 7 to avoid deformation of the ring 7 occuring.

In use of the flare unit, high pressure fuel gas enters the transfer chamber 4 from supply line 18. At a predetermined pressure, the fuel gas pressure in transfer chamber 4 causes the deformable element 7 to open, thus allowing gas to pass over the internal Coanda surface 5 to the throat of the Coanda body and thence upwards through the diffuser cone or trumpet 6 to emerge at the combustion zone above the mouth 10 of the trumpet. The Coanda effect causes entrainment of surrounding primary air so that a combustible mixture of fuel gas and air passes along the trumpet 6 to the combustion zone. In the arrangement shown in FIG. 1, secondary air between the flare units is also entrained to the combustion zone.

Figure 3:
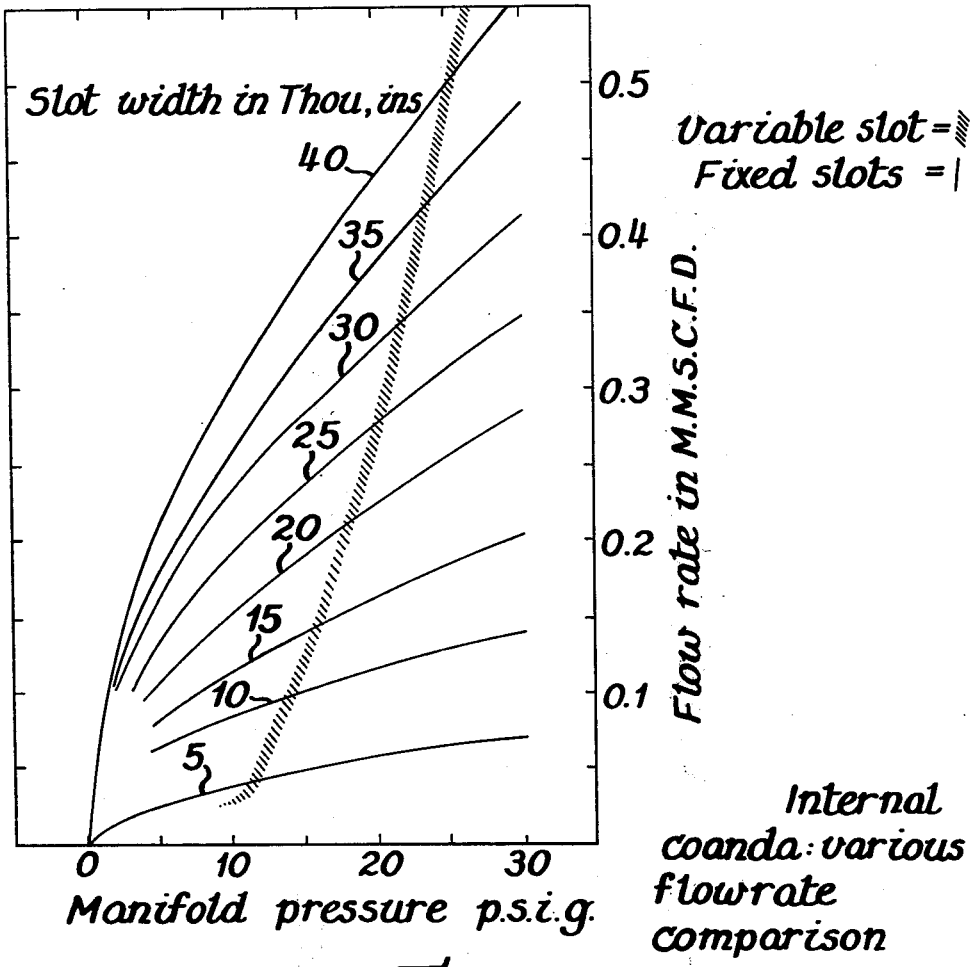
FIG. 3 is a graph of fuel gas flow rate and manifold pressure for internal Coanda flare units enabling comparison of fixed and variable slot embodiments.

FIG. 3 gives results for variable and fixed slot internal Coanda flare units. The dimensions of the flare unit used are as follows:-

| | |
|---|---|
| Coanda trumpet mouth diameter | = 350 mm |
| Coanda trumpet throat diameter | = 217 mm |
| Coanda trumpet included angle | = 3.5° |
| Annular ring external diameter at clamp point | = 402 mms |
| Annular ring internal diameter | = 274 mms |
| Annular ring thickness | = 2.52 mms |
| Annular ring material | = Ferrallium |
| Annular ring effective deformable length | $= \frac{402 - 274}{2} = 64$ mms |
| Annular ring maximum deflection (gap) | = 1.27 mms |
| (M.M.S.C.F.D - million standard cubic feet per day) | |

Typically the annular ring is pre-loaded against the Coanda surface so that opening of the slot does not occur until a gas pressure of 10 p.s.i. or more is reached.

Formulas for determining the characteristics of flat circular plates with central holes under various edge conditions and symmetrical loading are referred to by Trumpler et. al. (J. Applied Mechanics September 1943, A-173). These simplified formulas enable preliminary calculations to be made for the annular slot rings for various materials with respect to moment, deflection and angular deflection of plates having pressure and edge loading.

Figure 4:
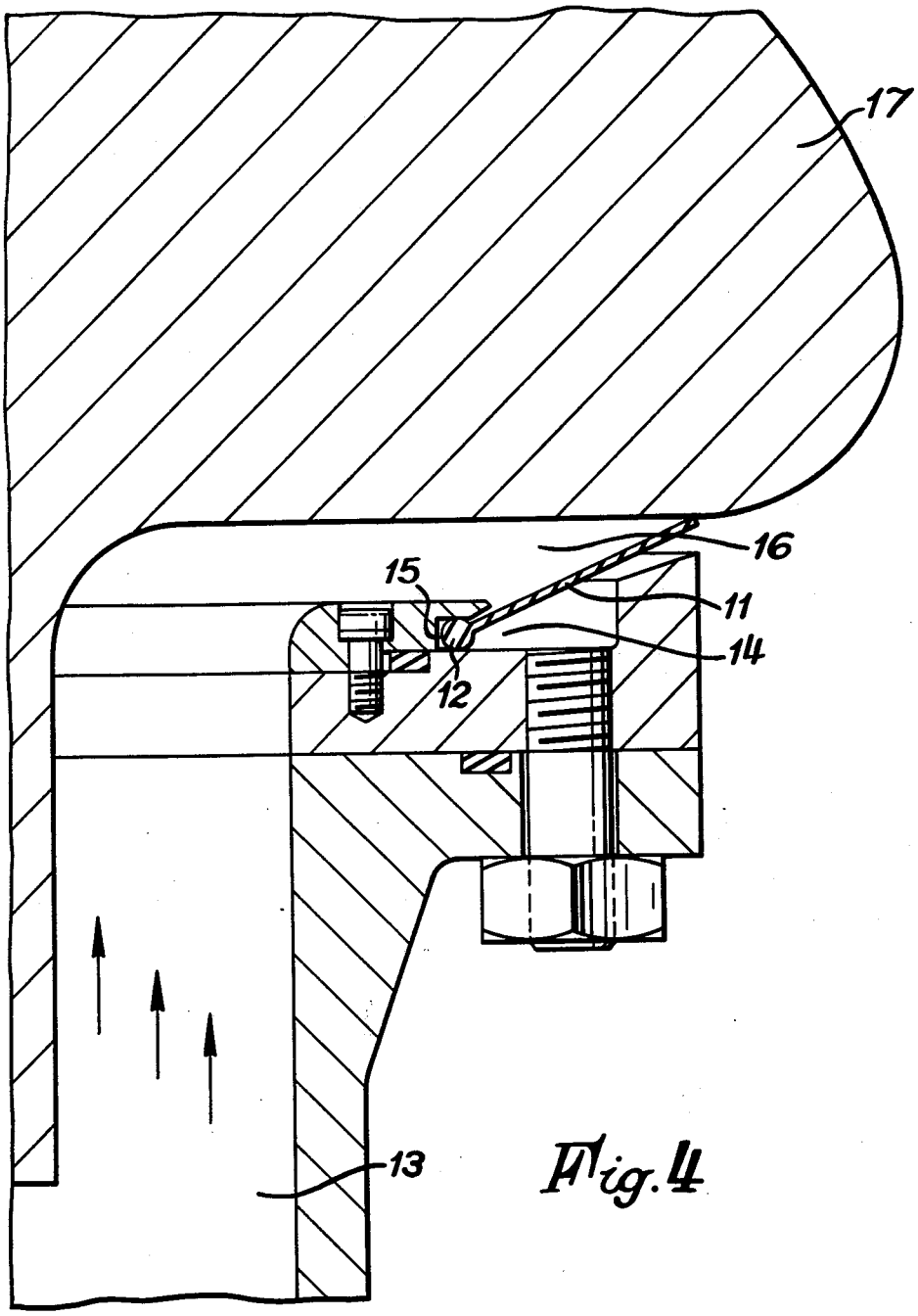
FIG. 4 is a vertical section of another embodiment of a flare unit using a deformable conical washer for slot width variation.

FIG. 4 shows a further embodiment of the invention using a deformable conical washer or Belleville washer 11 to obtain a variable slot flare on an external Coanda body 17.

The lip of the high pressure gas supply line 13 is fitted with a standard circumferential flange 14. The flange 14 has a recessed groove 15 in which is fitted a deformable slot ring or Belleville washer 11. A gas sealing element 12 forms part of the slot ring so as to prevent high pressure fuel gas escaping otherwise than via the slot 16. When no fuel gas flows along supply line 13, the slot ring 11 presses against the base of the Coanda body 17.

During use of the flare, the high pressure fuel gas passing along line 13 causes the deformable slot ring 11 to open. The characteristics of the slot ring 11 are chosen so as to give a substantially constant deflection per unit pressure applied, i.e. a constant load characteristic. After passing through the slot 16, the fuel gas passes as described above over the Coanda surface.

The slot ring 11 comprises a hollow conical disc (Belleville washer) and is made from a resilient, deformable material e.g. a martinsitic steel, and has a high modulus of rigidity.

Figure 5:
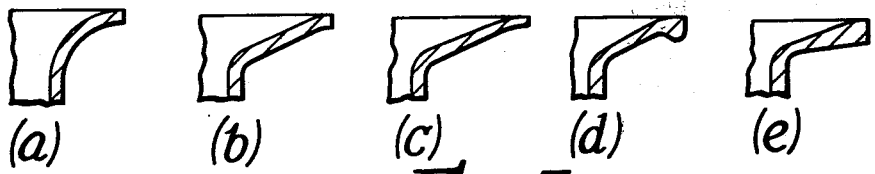
FIG. 5 shows various shapes of slot rings suitable for use with the Coanda flare.

FIG. 5 illustrates the various cross-sections of slot rings 11 that may be used in the system.

I claim:

1. A Coanda unit comprising a supply line for a pressurized gas and a Coanda body positioned across the outlet of the supply line so as to define a slot for discharging the gas along the surface of the Coanda body, one edge of said slot being contiguous with the Coanda surface, the opposite edge of said slot being defined by a resilient flap operatively coupled to said unit, said resilient flap being pre-loaded against said Coanda body so as to keep said supply line closed until a pre-determined gas pressure level is reached and said resilient flap being arranged to flex in response to gas pressures in excess of said pre-determined gas pressure level to form an effective slot width in the range of about 0 to about 0.05 inches, depending on the pressure of the gas supply, so that a stable flame is maintained at variations in gas pressure in excess of said pre-determined gas pressure.

2. A Coanda unit according to claim 1 in which the resilient flap is an annular ring, the outer edge of the ring being held and the inner edge being free to move in response to the gas pressure.

3. A Coanda unit according to claim 1 in which the resilient flap is an annular ring, the inner edge of the ring being held and the outer edge being free to move in response to the gas pressure.

4. A Coanda unit according to claim 1 in which the resilient flap comprises a resilient truncated conical ring.

5. A Coanda unit according to claim 4 in which the resilient truncated conical ring is a Belleville washer of constant thickness.

6. A Coanda unit according to claim 1 in which the resilient flap is constructed from a resilient material of high modulus of rigidity.

7. A Coanda unit according to claim 6 in which the resilient flap is constructed from martinsitic steel, ferritic stainless steel, a heat treated stainless steel, beryllium-copper, aluminium alloys, or a carbon fibre composite.

8. A Coanda unit according to claim 1 comprising a means for reducing gas velocity after its passage over the Coanda surface.

9. A Coanda unit according to claim 8 in which the means for reducing gas velocity is a tube of increasing cross-section area.

10. A Coanda unit according to claim 8 in which the means for reducing gas velocity, for an internal Coanda body, is a diffuser cone.

11. A Coanda unit according to claim 10 in which the diffuser cone has an included angle of 3°–10°.

12. A Coanda unit according to claim 11 in which the diffuser cone angles is 4°–6°.

13. A Coanda unit according to claim 10 in which the diffuser cone mouth diameter is 1.5 to 2 times that of its throat diameter.

14. A Coanda unit according to claim 1 having a baffle located above the unit.

15. An array of Coanda units according to claim 10 in which the centers of each Coanda unit are separated from each other by a distance of 3 diffuser cone exit diameters.

16. A Coanda unit according to claim 1 in which said resilient flap opens said slot at pressures in excess of about 10 p.s.i.

* * * * *